United States Patent [19]

Schaeff

[11] Patent Number: 4,602,821

[45] Date of Patent: Jul. 29, 1986

[54] COMBINED SHOVEL AND ROCK BREAKING CHISEL FOR AN EXCAVATOR

[75] Inventor: Hans Schaeff, Langenburg, Fed. Rep. of Germany

[73] Assignee: Karl Schaeff GmbH & Co. Maschinenfabrik, Langenburg, Fed. Rep. of Germany

[21] Appl. No.: 655,536

[22] Filed: Sep. 28, 1984

[30] Foreign Application Priority Data

Sep. 30, 1983 [DE] Fed. Rep. of Germany ..... 3335509

[51] Int. Cl.[4] ..... E02F 3/36

[52] U.S. Cl. ..... 299/67; 37/DIG. 3; 173/46; 299/69

[58] Field of Search ..... 37/117.5, DIG. 3, DIG. 12, 37/118 R, 141 R; 299/45, 67, 69; 173/29, 46; 172/247, 251, 253, 254, 438, 777, 778, 815, 701.1; 414/912, 722

[56] References Cited

U.S. PATENT DOCUMENTS

| | | | |
|---|---|---|---|
| 2,664,651 | 1/1954 | Woodward | 172/777 X |
| 4,041,624 | 8/1977 | Fryrear | 414/722 X |
| 4,070,772 | 1/1978 | Motomura et al. | 173/46 X |
| 4,466,494 | 8/1984 | Hanson | 37/DIG. 3 |

FOREIGN PATENT DOCUMENTS

| | | | |
|---|---|---|---|
| 2194849 | 3/1974 | France | 299/67 |
| 2268121 | 11/1975 | France | 37/DIG. 3 |
| 1553431 | 9/1979 | United Kingdom | 299/69 |
| 267549 | 7/1970 | U.S.S.R. | 299/67 |
| 703629 | 12/1979 | U.S.S.R. | 37/DIG. 12 |
| 846671 | 7/1981 | U.S.S.R. | 37/DIG. 3 |

*Primary Examiner*—Clifford D. Crowder
*Attorney, Agent, or Firm*—Shlesinger Arkwright Garvey & Fado

[57] ABSTRACT

A guide member is mounted to the housing frame to be integrated into the boom or shovel arm of a hydraulic excavator to control an additional implement in the form of a clearing blade or clearing shovel which is displaceable on the guide member between a rest position laterally abutting the housing frame and an operational position pointing approximately in the same direction as the actual hammer and which can be locked in place at least in each of the end positions.

5 Claims, 7 Drawing Figures

COMBINED SHOVEL AND ROCK BREAKING CHISEL FOR AN EXCAVATOR

The invention concerns an excavator or a similar equipment with a hydraulic hammer or rock crusher of which the housing part is adjustably fastened to the excavator boom or to an extension arm or shovel arm extending from said housing.

It is known with respect to hydraulic axcavators to exchange the excavating shovel or another work implement as needed with a hydraulic rock crusher which typically is called hydraulic hammer. Using the hydraulic hammer actuated by the pressurized oil flow from the hydraulic excavator, rock, concrete or masonry is broken up, for instance in demolition or on rocky ground.

The moment a rock or a stone block has been broken up to the desired degree, the small parts must be evacuated, i.e. cleared away, and put aside or moved away in order to have new access to the concrete block or rock formation. During this procedure it would be advantageous operationally to be able to exchange arbitrarily often and as needed the hydraulic hammer with an excavating shovel or a clearing blade. The net weight of these implements (for instance between 300 kg and 1,000 kg) in particular renders very difficult carrying out such an exchange at the work site. Furthermore, the connection and disconnection of the hydraulic lines to and from the implements always entails oil losses.

These features are compounded by lack of space when working in tunnels or galleries. In this regard, a hydraulic excavator is known, which has a contour fitted to the inside contour of such galleries and where the hydraulic hammer and a clearing shovel are supported about the same center of rotation at the shovel arm, both implements being alternately coupled to the same hydraulic cylinder. Besides the already cited problems relating to the hydraulic connections and disconnections, this known design already appears to incur the drawback that it requires first pivoting the hydraulic hammer together with its housing part out of the way of the clearing shovel until resting against the shovel arm and requiring being locked there before the clearing shovel can be put into action.

It is the object of the invention to so improve an hydraulic excavator of the initially cited kind that it will be possible to selectively use a clearing blade or shovel, or a hydraulic hammer, without reconnecting hydraulic lines and also without switch-over work, merely by disconnecting a locking means or similar fasteners.

To solve this problem, the invention proposes mounting a clearing blade or shovel as an additional operational implement on a guide member at the hammer chassis, between a rest position laterally against the said hammer chassis and an operational position pointing approximately in the same direction as the hammer, said blade or shovel being displaceable and lockable at least in each end position.

Due to this basic proposed solution, that is by mounting the evacuation implement at the chassis of the rock crusher, there arises an advantageously simple and economical design with adequate mobility and span of the clearing means. In order to selectively make operational the clearing implement of the rock crusher, merely easy manual actuations, but no complex procedures, are required, as the adjustability, i.e. pivoting range of the hammer chassis is present anyway within comparatively wide limits and is utilized at the same time for the mobility of the clearing implement. In simple embodiments of the invention, this mobility of the hammer chassis furthermore results in transferring the clearing implement from the rest position to the operational one, and vice-versa. Due to these simple manoeuvers and due to the simplicity in design, either the rock crusher or the clearing implement shall be quickly available as needed, without thereby requiring long shutdown times of the excavator. Another advantage found in most embodiments of the invention is that when moving the clearing implement into its operational position and also during actual use, the hammer proper, that is a flat or pointed chisel, can remain in the implement seat of the hammer chassis.

In a first basic embodiment of the above outlined invention, the additional operational implement in the form of a clearing blade is displaceably held in a guide means substantially parallel to the direction of the chisel and can be lcoked both in the raised rest position and in the operational position projecting downward beyond the implement seat, the clearing blade in the latter case also enclosing the guide means by a support section. In this embodiment the clearing blade is displaceable substantially in parallel to the hammer chassis, i.e. to the chisel direction, and upon elimination of locking said blade practically by its own weight arrives in the operational position pointing in the same direction as the chisel.

Appropriately the clearing blade is held on a guide plate specially designed as a flat guidance means even though other guide designs, for instance rod or cylinder guides, dovetail guides and the like are possible in principle. In the case of the simple guide plate, the clearing blade may comprise a flat bottom extending in the same plane as the guide plate, whereas the side edges of the guide plate can be overlapped at the rear of the clearing blade in the area of the support section by guide rails mounted on the bottom of the clearing blade. An advantageously applied design principle consists in permanently keeping the rear end of the clearing blade in contact with the guide so as to act as support section, while the forward free end of the clearing blade is available for evacuation, that is to move aside the reduced rock. In such work there is no need to move aside the chisel proper. The bottom of the clearing blade can be designed to be at least in part the support and guide member resting against the guide plate. In this manner a support additional to that from the guide rail enclosing the guide plate is obtained and a more advantageous transmission of force is achieved from the clearing blade to the hammer chassis.

It might be appropriate to provide the clearing blade with an essentially plane bottom and adjoining perpendicular side walls, whereas the free end of the bottom is designed as a cutting edge or claw. In a preferred embodiment the side walls of the clearing blade enclose the hammer chassis with a lateral spacing in such a manner that for the operational position of the clearing blade, the implement seat and the chisel so to speak are located within or "on" the clearing blade of which the forward end projects beyond the free end of the chisel. This embodiment will be appropriate because when the clearing blade is set flat, i.e. horizontal, for instance when moving underneath a layer of debris or of material to be removed when still being on intact rock, or where similar work is the case, the chisel remaining in its seat will create no difficulty at all.

In a further embodiment of the above cited first basic design of the invention, the clearing blade is provided with fittings inlcuding aligned eyes, said fittings being mounted for instance at the guide rails in mutually parallel manner and being provided to lock said clearing blade in the end position at the support section, said eyes being for a pin means associated with both feed-through apertures in the end positions in the hammer chassis and stop means at the chassis in the path of said fittings. Where called for, obviously different stop and locking means may also be provided for the clearing implement.

In a variation of the invention, the clearing blade can be made hydraulically displaceable to and fro on its guide means and be locked into its end positions. This design can be carried out for instance using an additional hydraulic cylinder mounted on the hammer chassis and driven jointly by the excavator hydraulics without inducing significant additional cost. When the clearing blade is hydraulically adjusted, the above described mechanical locking into the end positions becomes superfluous. The hydraulic adjustment drive furthermore will be advantageous too because the excavator operator no longer needs at all leave his cab when changing from the rock crusher to the clearing blade or vice-versa, as the locking into the end positions also takes place hydraulically now. In that regard the above described design of the clearing blade is furthermore advantageous because the chisel can permanently stay in its implement seat and the excavator operator accordingly need not leave his cab on account of the chisel.

A further design of the invention is a second basic embodiment for which the additional operational implement is held on a support fitting mounted sideways at the housing of the rock crusher so as to be pivotable about a horizontal shaft and so as to be locked in place by pin means between the raised rest position and the operational position projecting down beyond the implement seat. Preferably the implement is in the form of a clearing shovel with a rigid connecting bracket which can be locked in place in the upper rest position and in the down-pivoted operational position by means of a plug-in spindle on a support fitting starting at the hammer chassis. Regardless of the additional implement pivotably supported from the hammer chassis being a clearing blade or shovel, the chisel can remain in its seat when carrying out certain work for which the clearing means when in its operational position projects beyond the front end of the chisel.

The mechanical locking in the end positions using the pin means can be eliminated where the additional implement pivotable about a transverse shaft mounted on the hammer chassis is itself pivotably driven by a hydraulic cylinder. If a substantial pivoting motion of about 180° is required of the implement in order to change between the rest and the operational positions, the drive from the hydraulic cylinder is transmitted through tipping levers and control links. Appropriately the clearing blade or clearing shovel should point by its open side toward the hammer chassis when in the raised rest position.

Another basic embodiment of the invention is characterized in that the additional implement consists of an excavator shovel pivotably supported on a transverse shaft mounted at the lower end of the hammer chassis and moved by means of a hydraulic cylinder through tipping levers and control links across an angular range of at least 180° about the lower end of the hammer chassis in stepless, i.e. continuous manner and which furthermore can be locked in the end positions as well as in any intermediate one. This variation always offers advantages when the formations to be pierced for instance in tunneling vary between rocks and rock-free zones or when such are mixed and when satisfactory rates of advance can be achieved in the rock-free zones merely using an excavating shovel.

In an important variation, the hammer chassis may form the front part of a shovel arm hinging to the excavator boom. Such an integration of the hammer with the hammer chassis as part of the shovel arm results in a significant lowering in weight and furthermore in simplifying the drive means, all the more so that in the majority of applications, the range of pivoting of the shovel arm suffices for all required directions of advance of the chisel.

It may be appropriate to solidly lock, if in detachable manner, the hammer chassis to a shovel arm stub hinging at the boom. In this embodiment it is possible to dismantle the hydraulic hammer in case of damage and to exchange it against a replacement implement or against a smaller hammer.

The shovel arm side parts extend over the entire length of the shovel stem and can be joined by means of plate brackets, along the approximate length of the shovel arm stub connected to the boom, to a box or hollow support.

In a further development of the above described basic third embodiment of the invention, the hammer chassis can form the front part of the shovel and the hydraulic cylinder can be hinged to a rear section of the shovel arm to actuate the excavating shovel and furthermore can be connected to the excavating shovel by means of tipping levers located on both sides of the hammer chassis.

The discovered solution furthermore is advantageous because the excavating shovel and the associated drive means can be placed closer to the boom than in the state of the art where in a conventional hydraulic excavator the hammer housing typically replaces the shovel hinging to the shovel arm. Appropriately the excavator shovel is provided with fittings at its rear side which laterally enclose the lower end of the hammer chassis and so rest on pivot bolts projecting from the chassis that the excavating shovel freely pivots between its end positions about the lower end of the shovel arm or hammer chassis when the chisel is removed.

It is clear at once to the expert that the application of the above described novel combination of rock crusher and clearing implement in no way is restricted to excavators or similar equipment, but that instead it can be immediately carried over to stationary rock crushers in quarries, gravel plants and the like, that is to applications with corresponding equipment wherein another platform than a mobile undercarriage is used.

Further features and advantages of the invention will become clear from the description below of illustrative embodiments of the combination of rock-crusher and clearing implement in relation to the drawings showing essential details of the invention, and also from the claims. The particular features of the claims can be embodied individually or in several, arbitrary combinations. The following are shown in schematic manner:

Figure 1:
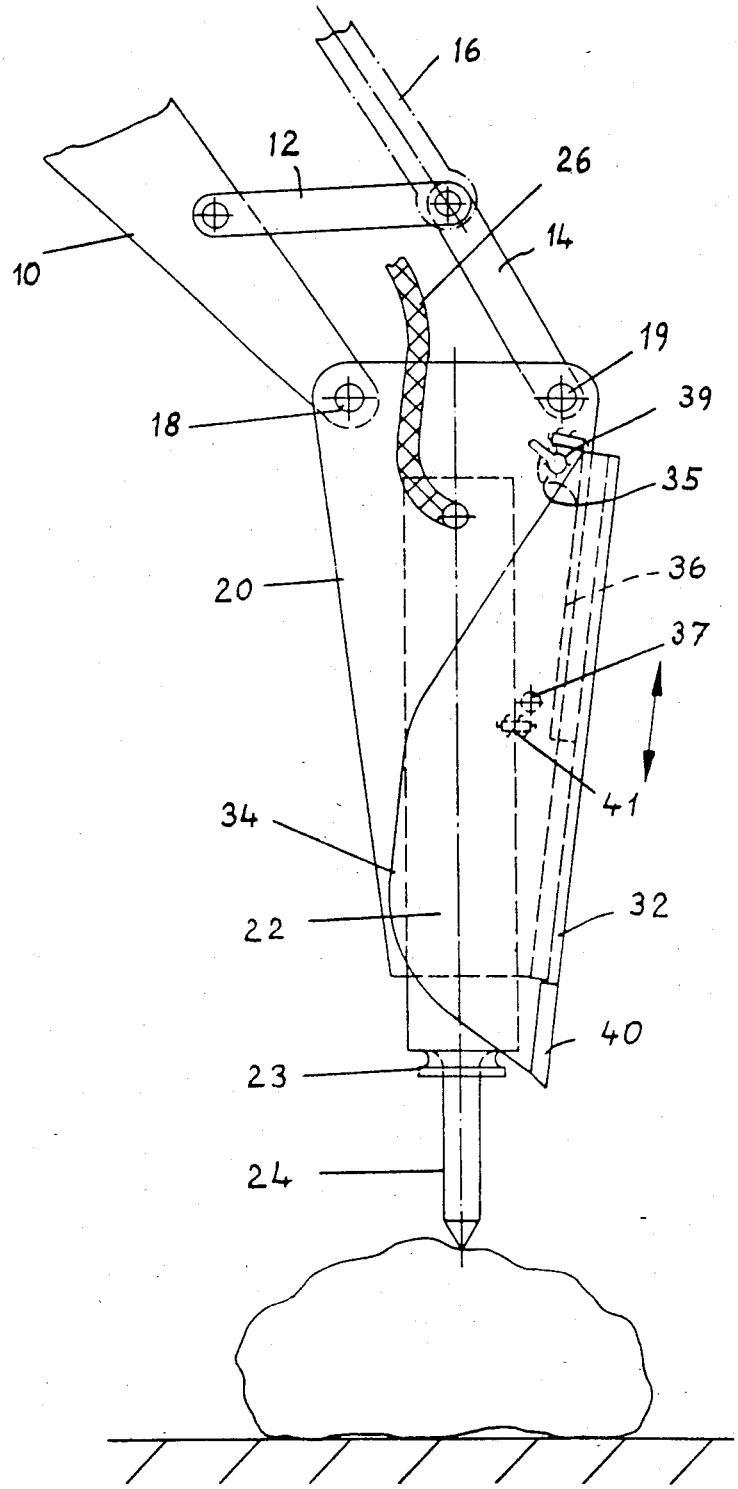
FIG. 1 is a sideview of a hydraulic hammer linked to a shovel arm and in combination with an associated clearing implement of the invention.
Figure 2:
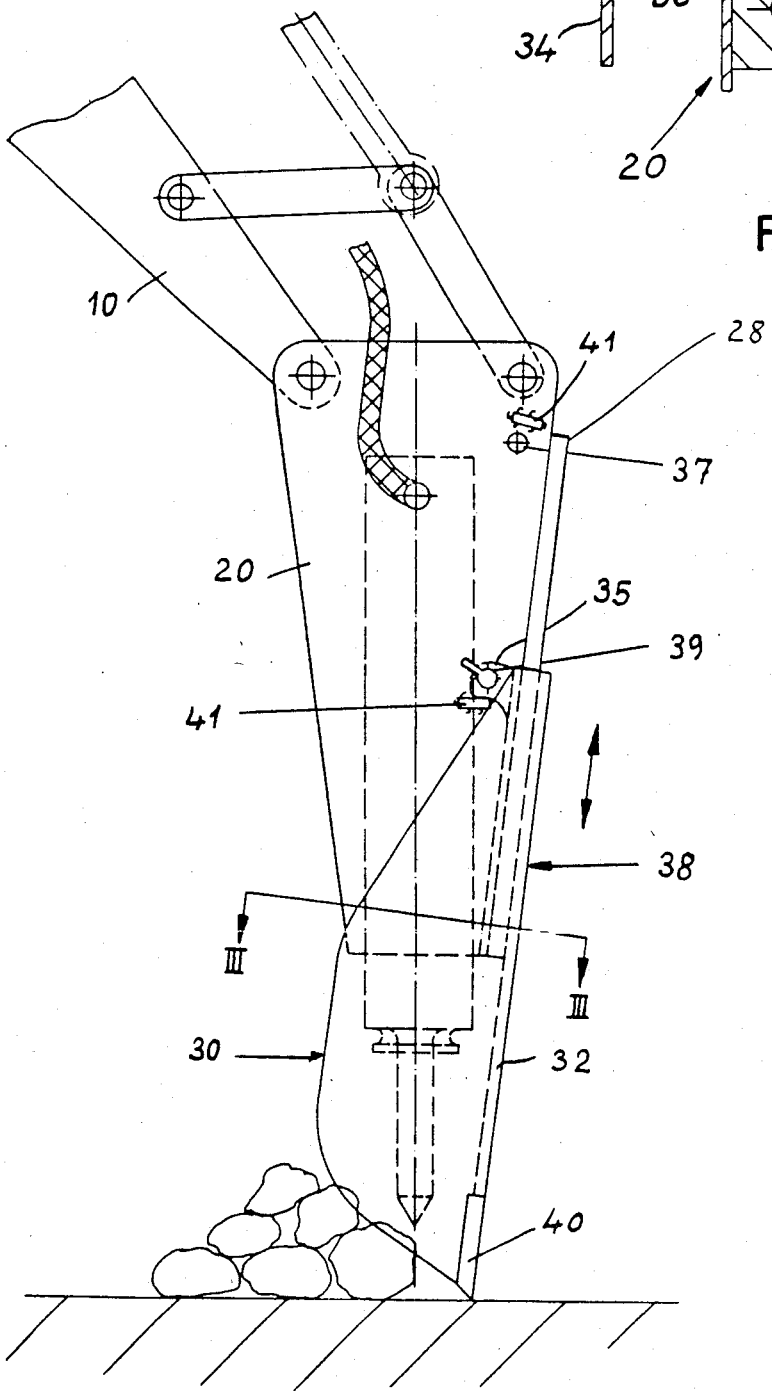
FIG. 2 is the same equipment as shown in FIG. 1, except for the clearing implement being in its operational position.

As shown in FIGS. 1 and 2, a housing or chassis 20 of a hydraulic hammer 22 acting as rock crusher is linked to the front end of a shovel arm 10 which for instance is connected to the boom of a hydraulic excavator (omitted), said hammer in an implement seat 23 being equipped with an exchangeable flat or pointed chisel 24. The hammer chassis 20 essentially consists of two parallel plates shown in contour in FIGS. 1 and 2 and between which is located the actual hydraulic hammer 22 connected by a hydraulic line 26 (pressurized feed line and unpressurized return line to the supply tank) to the hydraulic system of the excavator.

The hammer chassis 20 is pivotably connected by a bolt 18 to the shovel arm 10 and furthermore by a pivot pin 19 and a linkage system to the piston rod 16 of a hydraulic cylinder (omitted), by means of which the excavating implement typically linked to the shovel stem will be pivoted.

The steering system includes a tipping lever 12 acting on the shovel arm 10 and a control link 14 whereby the cylinder 16 makes possible a pivoting motion of 180° or more of the hammer chassis in order to set the required optimal hammer or chisel direction for the particular work site, for instance in a quarry to clear the quarry face or in street construction when breaking up old street layers, or when breaking up masonry, reinforced concrete, or foundations, or also for drifts in tunneling or in mining.

In the example shown in FIGS. 1 and 2, the rock crusher is set vertically to reduce the rock of FIG. 1 into rubble on the foundation. To clear the reduced material, a clearing blade 30 is provided at the hammer chassis 20 and can be moved on a guide plate 28 between the upper rest position of FIG. 1 and the lower operational position of FIG. 2.

Figure 3:
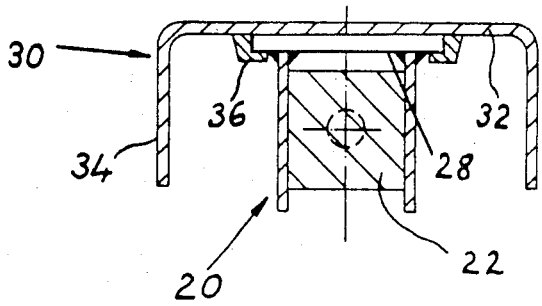
FIG. 3 is a section of the hammer and the clearing blade along line III-3 of FIG. 2.

As best shown by FIGS. 2 and 3, the guide plate 28 is welded to the end faces of the hammer chassis 20. The clearing blade 30 includes an essentially plane bottom 32 with approximately vertically adjoining side walls 34, creating a shape resembling a bucket. Guide rails 36 are mounted on the inside of the bottom 32 and enclose the free edges of the guide plate 28 which as shown in FIG. 3 is further enclosed by the bottom 32 to provide good guidance and support for the clearing blade. For the operational position of the clearing blade shown in FIG. 2, its rear rest section 38 remains engaged with the guide plate 28.

The clearing blade 30 is provided with upper and lower end positions defined by limit stops 41 at the hammer chassis 20 and indicated in FIGS. 1 and 2. Fittings 35 with eyes are integrated into the rear, upper end of the guide rails 36 and engage the limit stops 41 when in the end positions. Furthermore the eye-fittings 35 correspond to feed-through apertures 37 in the hammer chassis at the upper and lower end positions of the clearing blade, so that using the indicated plug-in bolts 39, the clearing blade can be locked into either end position. The free end of the clearing blade bottom 32 can used as a cutting edge or claw 40. As shown in FIG. 1, the clearing blade so encloses the hammer chassis by its side walls 34 that the clearing blade will not interfere with the rock crusher when latter is being operated. The shown mechanical end position locking means becomes superfluous where a hydraulic setting drive is provided for the clearing blade; this drive may be a simple hydraulic cylinder mounted in the area of the hammer chassis.

Figure 4:
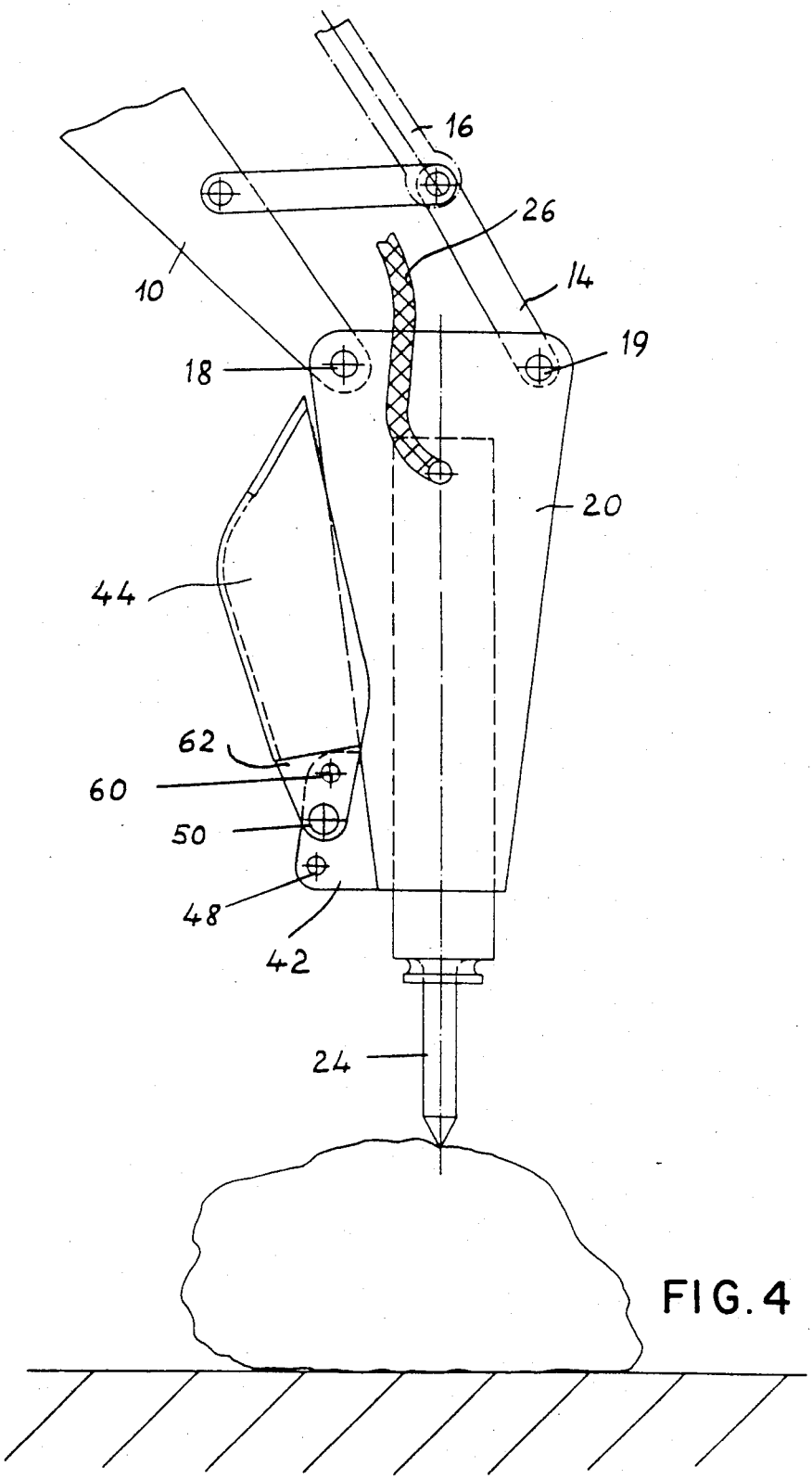
FIG. 4 is similar to FIG. 1 and shows a rock crusher housing hinged to a shovel arm and with clearance shovels mounted in laterally pivoting manner to said housing.
Figure 5:
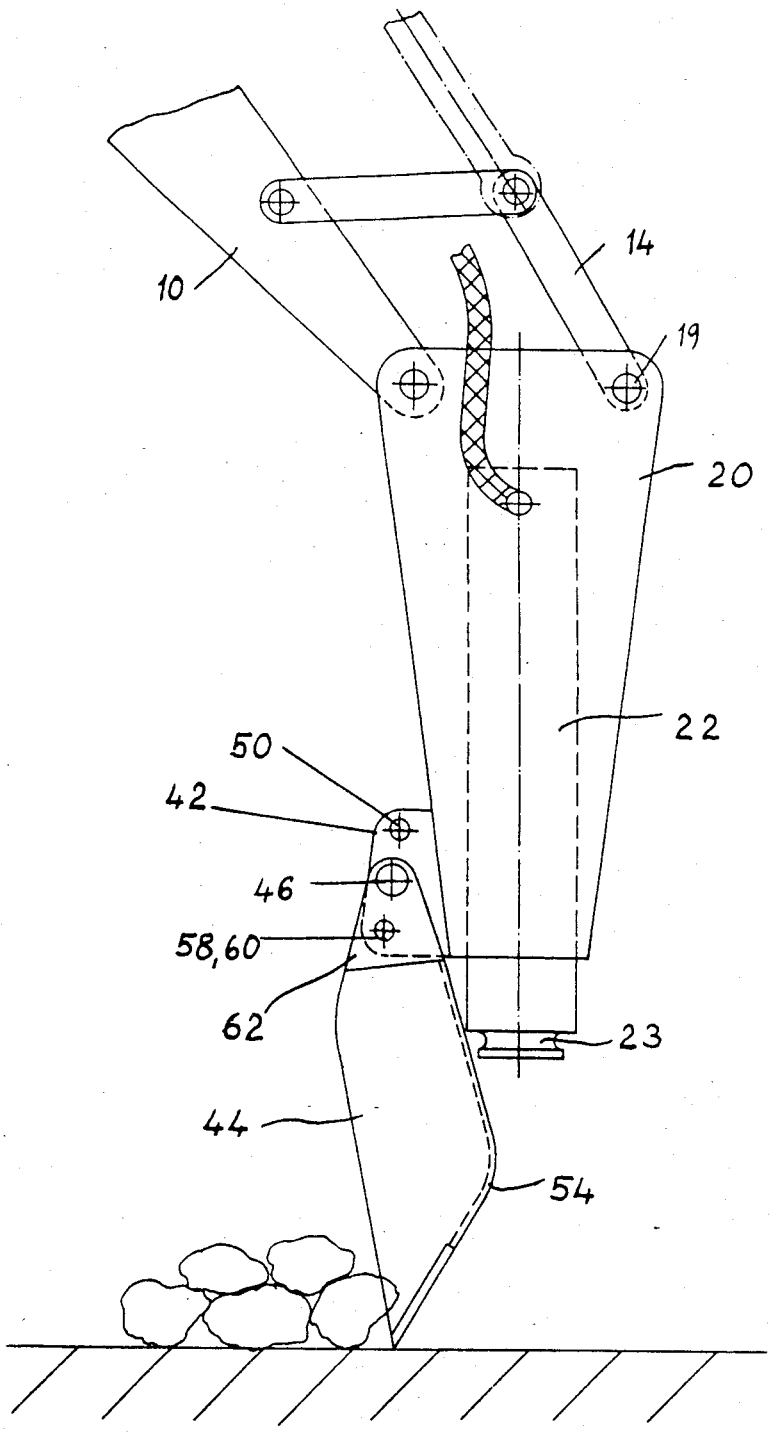
FIG. 5 is the same equipment as in FIG. 4 which however shows the clearing shovel in its lowered operational position.

In the embodiment of FIGS. 4 and 5 a clearing shovel 44 is mounted laterally to the hammer chassis 20 and pivots about a horizontal shaft 46 between its upper rest position and its lower operational position, being used in operation as a clearing blade as shown in FIG. 5. The clearing shovel 44 has a curved bottom 54 so as to allow picking up rock rubble or excavated material without slippage of latter when performing a pivoting motion.

The clearing shovel 44 is provided on its back side with two parallel pivot fittings 62 enclosing a support fitting 42 located laterally at the hammer chassis 20. The support fitting 42 supports the pivot shaft 46 passing also through the pivot fittings 62 of the shovel.

Two horizontal feed-through apertures 48,50 are present in the support fitting 42 and are resp. associated with the lower and upper end positions of the clearing shovel 44. The pivot fittings 62 of the shovel each include an aperture 58 which will be flush in the particular end position with the feedthrough apertures 48 and 50, whereby the particular end position of the clearing shovel 54 can be set in each case by one plug-in pin 60.

In the case of a hydraulic pivoting drive, omitted from FIGS. 4 and 5, for the clearing shovel 44, no locking means for the end positions would be required, while a power steering system would act on the suitably modified pivoting fittings 42 of the shovel to carry out the required 180° shovel swing by means of a hydraulic cylinder mounted to the hammer chassis.

Figure 6:
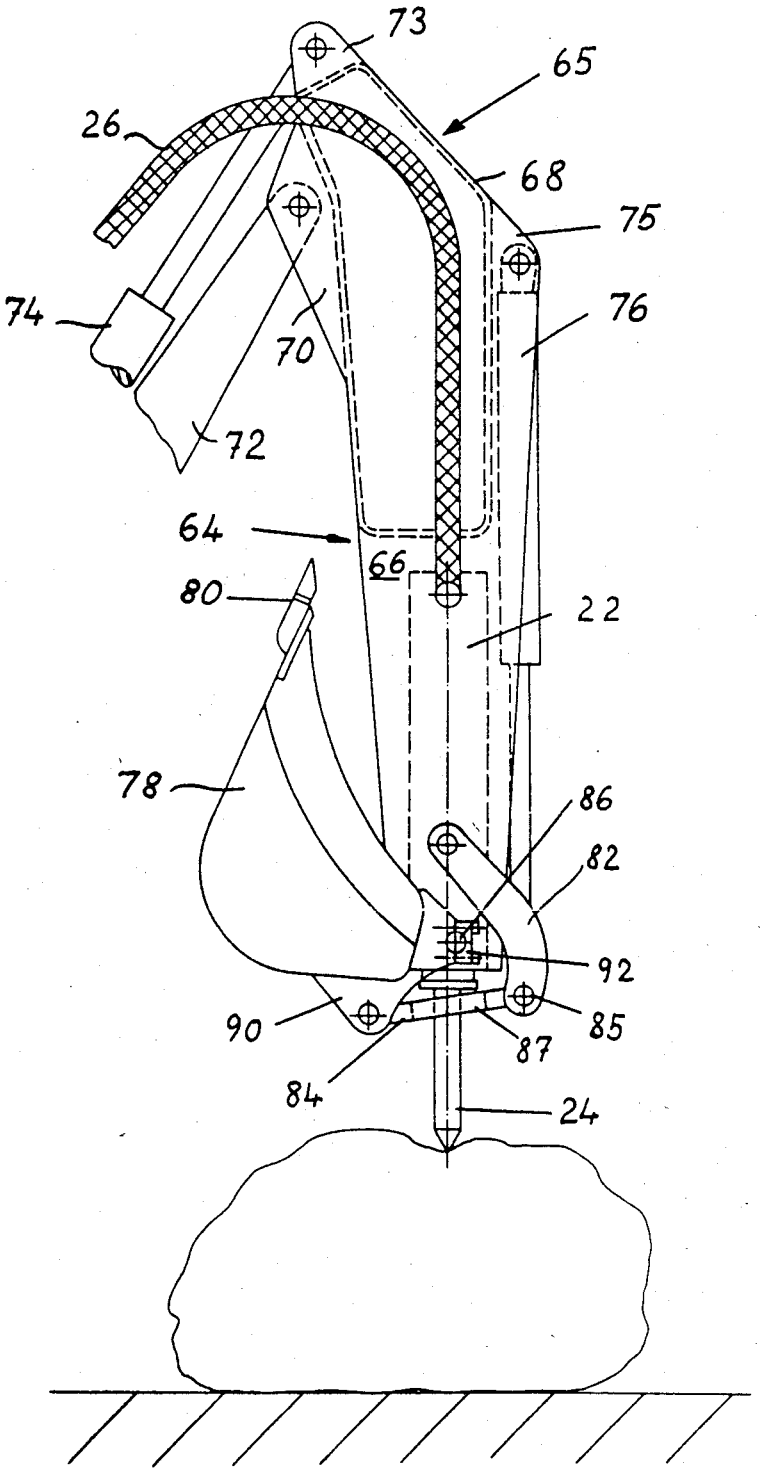
FIG. 6 is a sideview of another basic embodiment of the combination of rock-crusher and clearing-shovel of the invention, consisting of a boom-linked shovel arm of which the front section is an integral rock-crusher housing to which hinges an excavator shovel.
Figure 7:
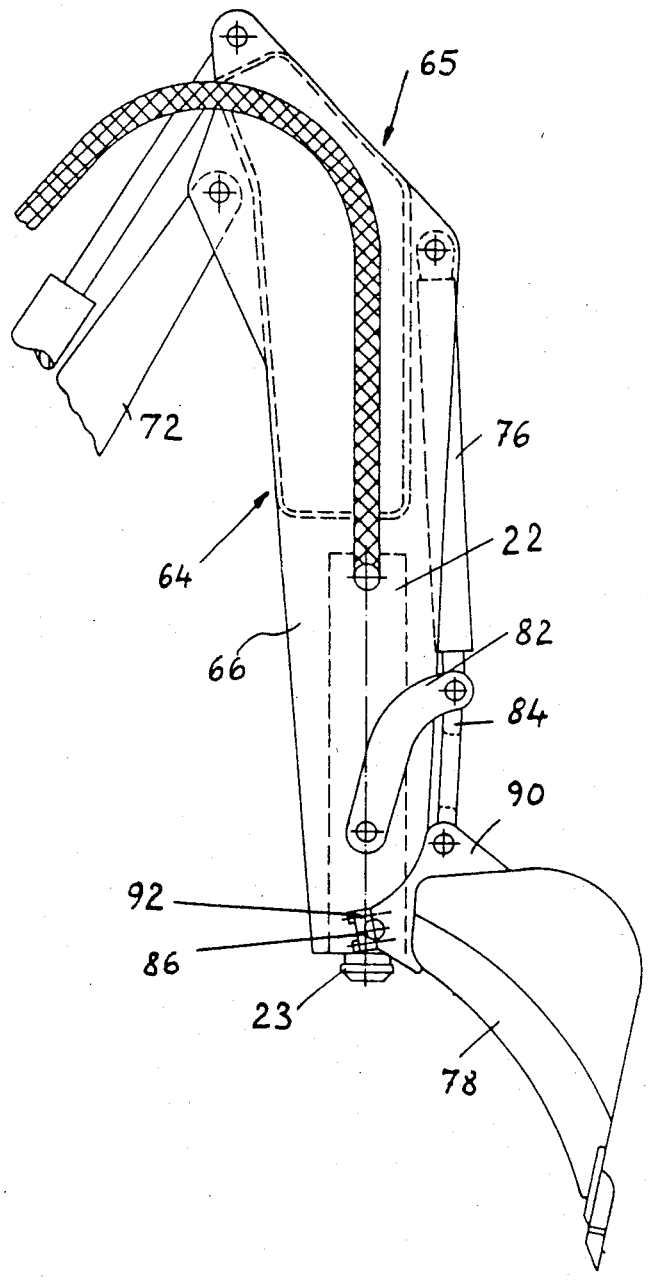
FIG. 7 is the same equipment as in FIG. 6, except that the excavating shovel is in its fully opened operational position.

The embodiment shown in FIGS. 6 and 7 displays a proposed solution whereby the hydraulic hammer, i.e. the hammer chassis, is integral with an excavator shovel arm 64. As a result the swing range of the rock crusher is restricted to that of the shovel arm which however suffices for most applications and their required chisel or hammer directions, whereby substantial simplifications and savings relating both to the drive means and weight are possible. In lieu of the shown installation of the hydraulic hammer 22 at the front end of the shovel arm 64, the design also may be such that a stub-shaped rear end of the shovel arm accepts a mass produced hammer chassis preferably in exchangeable, ie detachable manner.

The side parts 66 shown in FIGS. 6 and 7 and extending over the entire length of the shovel arm are connected approximately across the length of the stub area 65 above the hydraulic hammer by the bracket plates 68 indicated in broken lines to form a box. On this box are located support fittings 70 holding the excavator boom 72, furthermore pivot fittings 73 holding a swing cylinder 74 for the shovel arm, and also fittings 75 between which is located the bearing eye for a shovel swing cylinder 76.

An excavator shovel 78 is pivotably supported by the hammer chassis forming the front end of the shovel arm 64 and is shown in FIG. 6 being in its rest position, i.e. being swung laterally against the shovel arm, and in FIG. 7 in its opened operational position. At the lower end of the hammer chassis, support bolts 86 project to both sides, pivotably supporting the excavator shovel 78. Fittings 90 are located at the rear side of the excavator shovel 78 and are provided with detachable bearing shells 92 to permit assembling or disassembling the shovel. The piston rod of cylinder 76 acts on a transverse shaft 85 which on one hand connects two identical tipping levers 82 located on both sides of the shovel arm, ie of the hammer chassis, and which on the other hand is acted on by one end of a plate-shaped control link 84 of which the other end is linked to the rear attachments 90 of the excavator shovel 78.

As shown in FIG. 6, the plate-shaped control link 84 is provided with a central aperture 87 which forms a passage for the chisel 24 in the folded up rest position of the shovel 78. The plate-shaped control link 84 can be replaced by two individual links, each of which passes at the side of the chisel 24. Contrary to the embodiment of FIG. 5, the present design of the excavator shovel requires that prior to its actuation the chisel be disassembled, though this is a very simple matter by knocking out a locking key. The shovel teeth indicated by 80 are required only for dredgeable material, for instance also for debris. If rock is encountered when operating with this combination, the shovel as before first assumes the role of a clearing blade to remove the reduced rock which thereupon can still be loaded into the shovel.

I claim:

1. An excavator tool assembly which is pivotally mounted on an elongated boom, comprising, an elongated hydraulic hammer chassis having an elongated rock breaking chisel at the lower end thereof, the chassis at its upper end having a substantial lateral dimension with two spaced corners, one of which is pivotally connected at one end of the boom, and the other corner pivotally connected to a movable mechanical displacement element, a clearing blade having a plane bottom and adjacent side walls extending substantially perpendicular thereto to define an inner hollow scoop-shaped surface, the clearing blade being adjustably mounted on the chassis such that in its inoperable stored position it is disposed with its plane bottom immediately beside the chassis with its inner hollow scoop-shaped surface facing and surrounding the chassis with the plane bottom surface disposed parallel to the axis of the pivotal connection between the boom and the chassis in both its upper stored position above the lower surface of the chassis and also in its lower operating position, in both positions the clearing blade being substantially parallel to the longitudinal axis of the chisel, the blade having means thereon for providing locking of the blade in both the inoperable upper stored position and the lowered work position, movement of the chassis about its pivot support providing for movement of both the chisel and the blade, the clearing blade being supported and guided for movement between the upper and lower positions along a flat guide plate, the exterior surface of the plane bottom being connected to the guide plate for reciprocable movement.

2. The excavator as set forth in claim 1, wherein, the lower free end of the clearing end is in the form of a cutting edge.

3. The excavator as set forth in claim 1, wherein, the clearing blade and the chassis have means for interlocking such that the clearing blade can be locked in either the upper inoperable position or the lower working position.

4. The excavator as set forth in claim 3, wherein the chassis and the clearing blade have fittings and aligned eyes to provide said means for interlocking.

5. The excavator as set forth in claim 1, wherein the movable mechanical displacement element is part of an actuating hydraulic cylinder assembly.

* * * * *